US005133088A

United States Patent [19]

Dunlap

[11] Patent Number: 5,133,088

[45] Date of Patent: Jul. 28, 1992

[54] SOCK PAD AND METHOD

[76] Inventor: Albert R. Dunlap, 502 W. Elm St., Graham, N.C. 27253

[21] Appl. No.: 747,358

[22] Filed: Aug. 20, 1991

[51] Int. Cl.[5] ..... A41B 11/02

[52] U.S. Cl. ..... 2/241; 2/61; 2/267; 2/239; 2/DIG. 6

[58] Field of Search ..... 2/241, 61, 267, 239, 2/DIG. 6, ; 66/182

[56] References Cited

U.S. PATENT DOCUMENTS

| | | | |
|---|---|---|---|
| 1,581,067 | 4/1926 | Kleindienst . | |
| 2,283,278 | 5/1942 | Morse . | |
| 2,288,361 | 6/1942 | Kress et al. . | |
| 2,996,726 | 8/1961 | Mayer . | |
| 3,146,468 | 9/1964 | McDonald | 2/61 |
| 3,289,329 | 12/1966 | Weiss | 2/61 |
| 3,315,276 | 4/1967 | Daxe | 2/61 |
| 3,457,739 | 7/1969 | Frand et al. . | |
| 3,601,818 | 8/1971 | Chesebro et al. . | |
| 3,983,870 | 10/1976 | Herbert et al. . | |
| 4,106,126 | 8/1978 | Traenkle | 2/DIG. 6 |
| 4,651,354 | 3/1987 | Petrey | 2/239 |

*Primary Examiner*—Werner H. Schroeder
*Assistant Examiner*—Gloria Hale

[57] ABSTRACT

A sock and method for manufacturing the same utilizes a formable or "puff" ink. The ink is applied by screen printing to the upper heel area of the sock and the ink is heat set. The ink rises upon setting (curing) to form a friction producing surface on the back of the sock above the heel. The printed surface prevents to sock from sliding into the shoe during periods of exercising such as walking, jogging or other physical activities.

15 Claims, 2 Drawing Sheets

SOCK PAD AND METHOD

BACKGROUND OF THE INVENTION

1. Field Of The Invention

The invention herein pertains to footwear and particularly to socks which include a means for preventing the sock from sliding into the shoe during exercise.

2. Description Of The Prior Art And Objectives Of The Invention

Foamable or "puff" inks have been utilized for many years in "screen" and other types of printing whereby the ink composition is applied to t-shirts and other items for raised, decorative purposes. These inks expand or rise slightly as they are heat-set or "cured" under elevated temperatures to provide a unique "relief" appearance. Some sock manufacturers in the past have applied these inks to the soles of socks to make the socks more durable and suitable for in home lounging, as worn without shoes. It is also well known in the sock and stocking manufacturing trade to utilize foldable tabs of knitted cloth or the like just above the heel portion of socks to help prevent the sock from sliding downwardly into the shoe during wear, which tabs can also be used to grasp and pull the sock out of the shoe, should such sliding occur. R. R. Weiss provides a sock with a one such tab in U.S. Pat. No. 3,289,329 and Chesebro, et al. illustrates a low cut sock having a tab in U.S. Pat. No. 3,601,818. The Weiss and Chesebro devices are useful under certain circumstances but both require procedures in addition to those normally taken in manufacturing conventional socks.

The present invention overcomes the disadvantages and problems associated with prior art devices and methods of producing such socks and one of its objectives is to provide a sock which includes a means for preventing the sock from sliding into the shoe during wear.

It is yet another objective of the present invention to provide a sock which can be easily and inexpensively produced yet which will furnish the advantages of a separately affixed foldable flap or tab.

It is still another objective of the present invention to teach a friction producing pad surface on the upper heel area of the sock which can be produced in a variety of decorative colors.

It is still another objective of the present invention to present a method for manufacturing a sock having a coated upper heel area which does not detract from the appearance of the sock.

Various other objectives and advantages of the present invention become apparent to those skilled in the art as a more detailed presentation is set forth below.

SUMMARY OF THE INVENTION

The aforesaid and other objectives are realized by providing a sock which may be of the conventional knit "low-cut" type to which a foamable composition as known in the industry as "puff" ink is applied to the upper heel area. The sock is then placed in an oven or other high temperature environment of from 350° F.–400° F. to heat-set the ink. During the heating process the ink swells or rises, thereby forming a raised surface or pad on the upper heel area of the sock, particularly at the rear of the sock above the heel. This raised surface will produce friction with the upper rim of a shoe thereby preventing the sock from sliding into the shoe during periods of various exercises or activities.

The ink may be formulated to have a substantially resilient or rubber-like feel upon setting, to thereby increase its friction producing properties as it contacts the shoe rim.

DESCRIPTION OF THE PREFERRED EMBODIMENT

Figure 1:
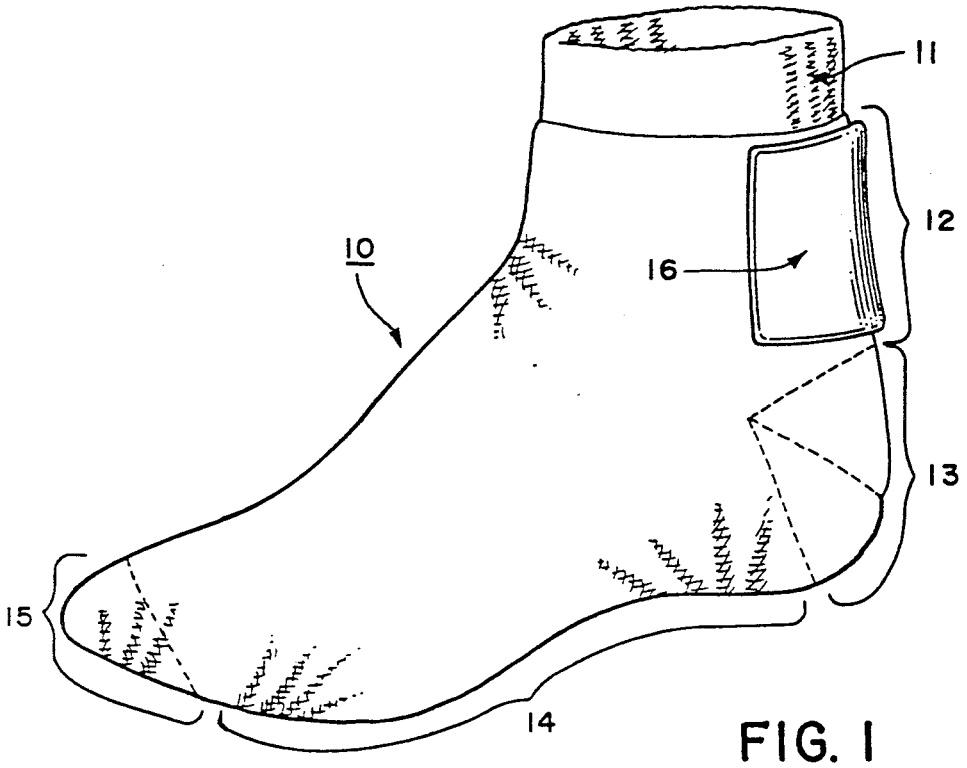
FIG. 1 illustrates a perspective view of a conventional low-cut sock illustrating the friction producing pad on the upper heal area.

The preferred sock of the invention is shown in FIG. 1 whereby a conventionally knitted low-cut sock includes a friction producing pad above the heel. The pad is formed from a foamable ink composition which prevents the sock from sliding into the shoe during wear. The friction producing pad extends upwardly from the top of the heel to the bottom of the upper welt and extends radially from ankle to ankle or approximately one hundred eighty degrees (180°). The preferred shape of the friction producing pad is in the form of a rectangle although other configurations can be utilized. The friction producing pad protrudes from the outer surface of the sock approximately one thirty-second of an inch to help prevent the sock from sliding into the shoe.

Figure 4:
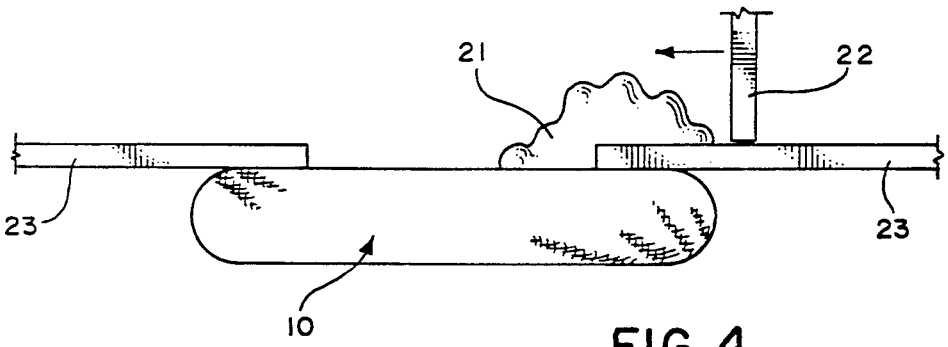
FIG. 4 depicts in schematic representation a method of applying the friction producing surface coating of the sock during screen printing.

The preferred method of the invention comprises knitting a sock such as of the low-cut variety and thereafter coating the boot of the sock with a foamable ink as illustrated in FIG. 4 such as by conventional screen printing methods. Thereafter the ink is heat-set in an oven or the like at approximately 350° F.–400° F. where the ink rises and cures to form the pad.

DETAILED DESCRIPTION OF THE DRAWINGS AND OPERATION OF THE INVENTION

Figure 3:
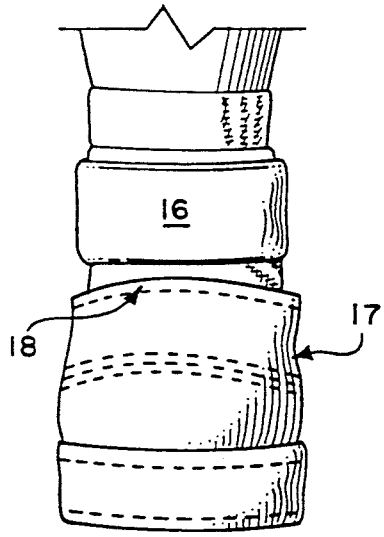
FIG. 3 shows a rear view of the sock and shoe as shown in FIG. 2.
Figure 2:
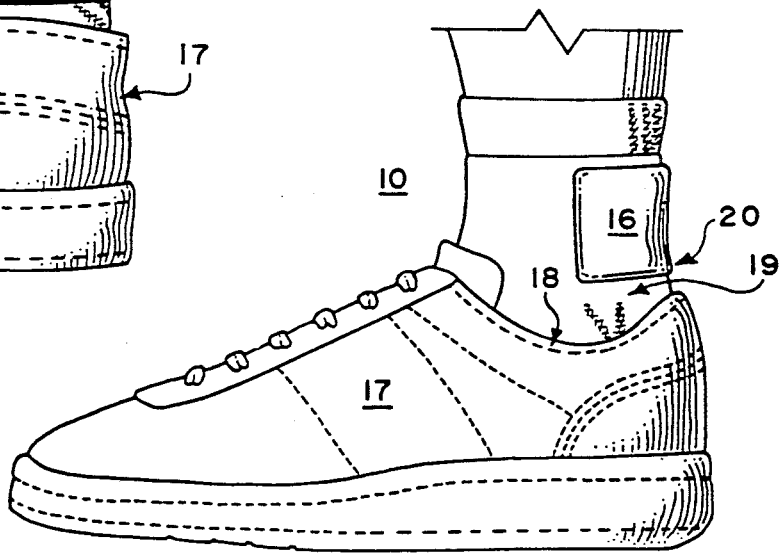
FIG. 2 demonstrates a side view of the sock as would be worn in a athletic shoe.

For a more complete understanding of the invention and its operation, turning now to the drawings, in FIG. 1 sock 10 which is a conventional low-cut knitted sock is shown, although other types and constructions could be utilized with the invention. Sock 10 includes an upper welt 11, an upper heal area 12, a heel 13, a body portion 14 and a toe 15. Upper heel area 12 comprises a relatively thin friction producing pad 16 which extends around the sock approximately one hundred eighty degrees (180°) and is in the general shape of a rectangle having a width from the top of heel 13 to the bottom of upper welt 11. Sock 10 can be worn with athletic shoe 17 such as a tennis shoe, "sneaker", or otherwise. As seen in FIGS. 2 and 3, shoe 17 includes an upper rim 18 which is just below friction producing pad 16 of sock 10. As further shown in FIG. 2, friction producing pad 16 extends outwardly from the outer surface 19 of sock 10 slightly as shown at 20 thereby demonstrating the thickness of pad 16 relative to the surface 19 of sock 10. As would be understood, friction producing pad 16 will prevent sock 10 from slipping into shoe 17 during periods of exercise or the like. It has been found that a thickness of approximately one thirty-second (1/32) of an inch above surface 19 of sock 10 has been sufficient for the intended purposes although other thicknesses may be useful under particular circumstances. Additionally, when the ink utilized to form friction producing pad 16 results in a substantially somewhat hard, "rubbery" feel, an improved result is achieved due to the frictional quality of pad 16.

Figure 5:
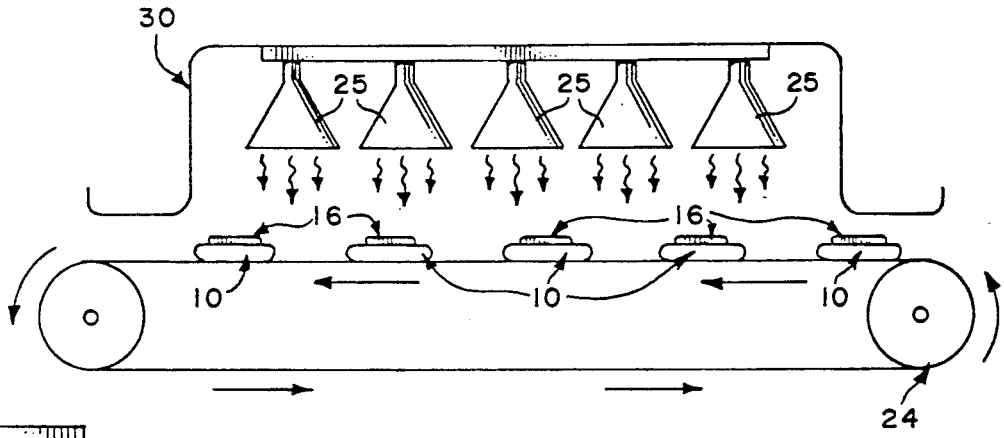
FIG. 5 represents a schematic view of a method of heat setting the ink composition of FIG. 4 to form the friction producing pad.

The method of forming sock 10 is demonstrated in FIG. 4 whereby a conventional foamable semi-liquid ink composition 21 is screen printed onto sock 10 by blade 22 as it moves across stencil 23. Once the printing has been completed, as shown in FIG. 4 only in schematic fashion sock 10 is then placed in oven 30 (illustrated schematically in FIG. 5) whereby ink composition 21 is then heat-set, where it rises in oven 30 as it moves along speed adjustable conveyor 24 and under radiant heat lamps 25 and thereby forms desired pad 16 on boot 12 of sock 10. The temperature for setting ink 21 is in the range of 350° F.–400° F. although other ink compositions may require a somewhat lower or higher temperature depending on the particular process employed and results desired. Wet ink composition 21 is intermingled with the yarn of sock 10 and pad 16 is thereby permanently affixed to sock 10 when ink 21 is cured under heat lamps 25.

Trademarks, logos and other indicia can be printed onto upper heal area 12 instead of the rectangular configuration shown herein and various colors of ink composition 21 can be provided depending on the particular decorative effect desired. As would be further understood, sock 10 is of the low-cut variety has been shown to illustrate the invention although other athletic types of socks and footwear can equally be used. Thus, the illustrations and examples provided herein are for explanatory purposes and are not intended to limit the scope of the appended claims.

I claim:

1. A sock for wear within a shoe, said sock having an upper heel area contiguous with the heel, the improvement comprising: a means to produce friction, said friction producing means comprising a cured foamable ink pad on said upper heel area to prevent said sock from sliding into said shoe, said friction producing means positioned on the outer surface of said upper heel area.

2. A sock as claimed in claim 1 wherein said friction producing means is positioned at the center of said upper heel area.

3. A sock as claimed in claim 1 wherein said friction producing means comprises a relatively thin pad.

4. A sock as claimed in claim 3 wherein said pad extends approximately one thirty-second of an inch beyond the outer surface of said upper heel area.

5. A sock as claimed in claim 1 wherein said friction producing pad extends from ankle area to ankle area around the upper heel area of said sock.

6. A sock for wear within a shoe, said sock having an upper heel area contiguous with the heel, the improvement comprising: a means to produce friction, said friction producing means positioned on the outer surface of said upper heel area, said friction producing means comprising a resilient pad, said pad having a thickness to extend slightly from the outer surface of said upper heel area to prevent the sock from sliding into the shoe during exercise.

7. A method of forming a sock having a friction producing upper heel area for preventing the sock from sliding into shoe during exercise, the method comprising the steps of:

a. forming a sock with an upper heel area contiguous with the heel, and b. coating the upper heel area of the sock with a friction producing composition.

8. The method of claim 7 and including the step of heat setting the composition.

9. The method of claim 7 wherein the step of forming said sock comprises knitting a sock.

10. The method of claim 8 wherein coating the upper heel area of the sock comprises the step of printing the upper heel area with a foamable ink.

11. The method of claim 8 wherein the step of heat setting the composition comprises heating the coated sock at a temperature above ambient temperature.

12. The method of claim 11 wherein the step of heat setting the coated sock to a temperature of between 350° F.–400° F.

13. The method of claim 11 wherein printing the upper heel area with an ink comprises screen printing the upper heel area with a heat setting ink.

14. The method of claim 8 wherein the step of coating the upper heel area with a friction producing composition comprises coating the upper heel area with a foamable ink which will rise upon heat setting.

15. The method of claim 8 wherein the step of coating the upper heel area of a sock comprises coating the rear portion of the upper heel area.

* * * * *